United States Patent [19]

Burek et al.

[11] 4,167,688

[45] Sep. 11, 1979

[54] COMPOSITE ILLUMINATION FIXTURE AND CONTROL CIRCUIT THEREFOR

[75] Inventors: Michael J. Burek, Ann Arbor; Robert S. White, Livonia, both of Mich.

[73] Assignee: Stirling-White Company, Inc., Farmington, Mich.

[21] Appl. No.: 938,082

[22] Filed: Aug. 30, 1978

Related U.S. Application Data

[63] Continuation of Ser. No. 778,012, Mar. 16, 1977, abandoned.

[51] Int. Cl.[2] ..... H05B 37/02; F24H 3/02; G08B 17/10

[52] U.S. Cl. ..... 315/178; 315/201; 315/205; 315/314; 315/320; 361/191; 219/361; 219/364; 219/501; 219/508; 340/628; 307/38; 307/41; 307/146

[58] Field of Search ..... 307/38, 41, 146; 361/189, 191; 315/135, 162, 165, 178, 201, 313–315, 320–323; 362/92, 96; 219/361, 364, 501, 508; 340/628–630

[56] References Cited

U.S. PATENT DOCUMENTS

| | | | |
|---|---|---|---|
| 2,997,607 | 8/1961 | Hill | 307/146 |
| 3,180,999 | 4/1965 | Kuykendall | 307/41 |
| 3,201,754 | 8/1965 | Reiner et al. | 361/191 X |

*Primary Examiner*—Alfred E. Smith
*Assistant Examiner*—Charles F. Roberts
*Attorney, Agent, or Firm*—Barnes, Kisselle, Raisch & Choate

[57] ABSTRACT

A control circuit including at least one switch and a plurality of rectifiers for selectively applying a-c utility power to either or both of two remote electrically-powered apparatus at respective first and second states of rectification by means of a conventional two-wire interconnection cable. Where one of the apparatus is of a type, such as a motor, adapted to be powered by a full-wave a-c, the control circuit includes a relay and relay switch responsive to switch-selectable half-wave a-c for connecting the motor to receive full-wave power. In one disclosed embodiment, the two apparatus comprise a composite smoke detector and lamp fixture, and the control circuit provides continuous power at a first state of rectification to the smoke detector portion of the fixture and switch-selectable power at a second state of rectification to the fixture lamp.

15 Claims, 6 Drawing Figures

COMPOSITE ILLUMINATION FIXTURE AND CONTROL CIRCUIT THEREFOR

This is a continuation of application Ser. No. 778,012, filed Mar. 16, 1977, now abandoned.

The present invention relates to electrical fixtures and, more particularly, to systems for selectively applying a-c utility power to two remote fixture loads by means of a two-wire interconnection cable.

To locate a conventional smoke detector in a pre-existing building, such as on a domestic hallway ceiling for example, the owner or installing party generally has two choices with respect to the manner of mounting the detector. He may cut a new hole in the ceiling for mounting of the smoke detector and associated junction box, or he may remove a pre-existing ceiling lamp and mount the smoke detector in place of the lamp. In domestic applications, the former choice has significant disadvantages in that the hole must be formed in ceiling plaster or dry wall, and usually, suitable a-c power must be wired to the desired location, both of which operations require skilled and expensive labor. To facilitate the latter method, smoke detectors designed for after-market domestic installation are generally adapted to be mounted to a standard four-inch-square junction box of the type commonly used for ceiling lamps. However, the latter choice has the obvious disadvantage of removing what may have been the only means for illuminating the area-in-question.

Homes or other buildings are usually wired during construction with a cable system having two power conductors or wires and perhaps one ground conductor. Where it is sought to selectively operate two or more electrical apparatus at one location by switch means located at a remote location, it is often necessary to "string" additional conductors through the building walls between the apparatus and the switch locations. Even where a three conductor cable, i.e., one having two power conductors and a ground conductor, is initially installed, additional conductors must be provided between the apparatus and the switch locations because, according to most building codes, a ground conductor may not be used as a power conductor for an electrical appliance. For this reason, the term "two-conductor cable" as used herein refers to a cable which includes two power conductors with or without a third ground conductor.

A general object of the present invention is to provide a control system for selectively operating two electrical apparatus from switch means located remotely of such apparatus using the previously-installed two-conductor cable.

Other objects of the invention are to provide composite fixtures, such as a combined smoke detector and lamp fixture, which are adapted to be easily and rapidly mounted to a standard pre-existing ceiling or wall lamp junction box, and which may be readily inspected and repaired in situ.

A further object of the invention is to provide a control circuit for a composite smoke detector and lamp fixture which is adapted to use an existing two-wire power system between a wall switch and the fixture site, and in which power is continuously applied to the smoke detection portion of the fixture but may be selectively applied to the fixture lamp in accordance with the condition of the wall switch.

In accordance with one important aspect of the present invention wherein one of the two apparatus is of a type, such as an a-c motor, adapted to be powered by full-wave a-c, the control circuit includes a switch adapted when closed to apply full-wave power to the two-conductor cable and a rectifier operatively connected across the switch for applying half-wave rectified power to the cable. A relay or the like is connected at the opposing end of the cable in series with a second rectifier poled in opposition to the first rectifier. When the switch is closed, one half-cycle of the full-wave power applied to the cable is conducted through the second rectifier and the relay to close the relay switch and thereby apply full-wave power to the motor.

The invention, together with additional objects, features and advantages thereof, will be best understood and appreciated from the following description when read in conjunction with the accompanying drawings in which.

Figure 1:
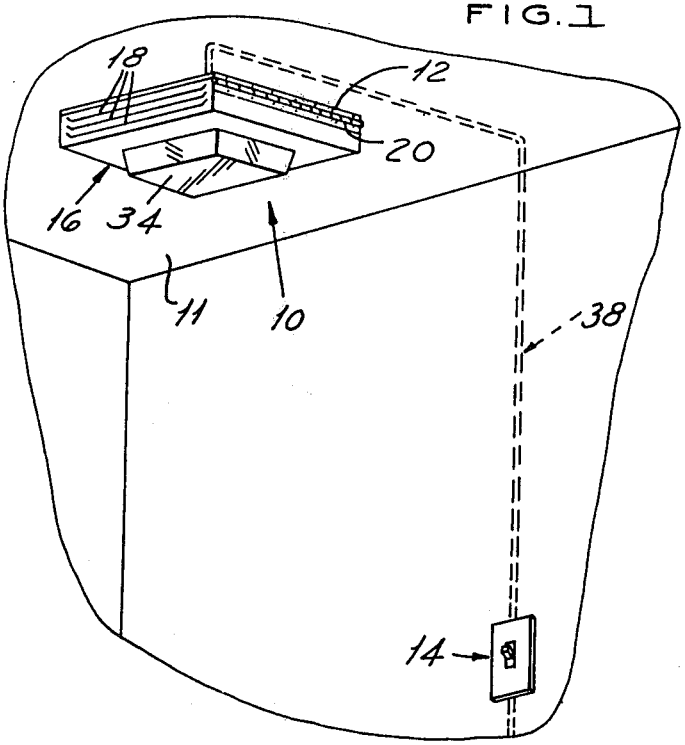
FIG. 1 is a perspective view of a composite fixture in accordance with the invention connected to a wall switch.
Figure 2:
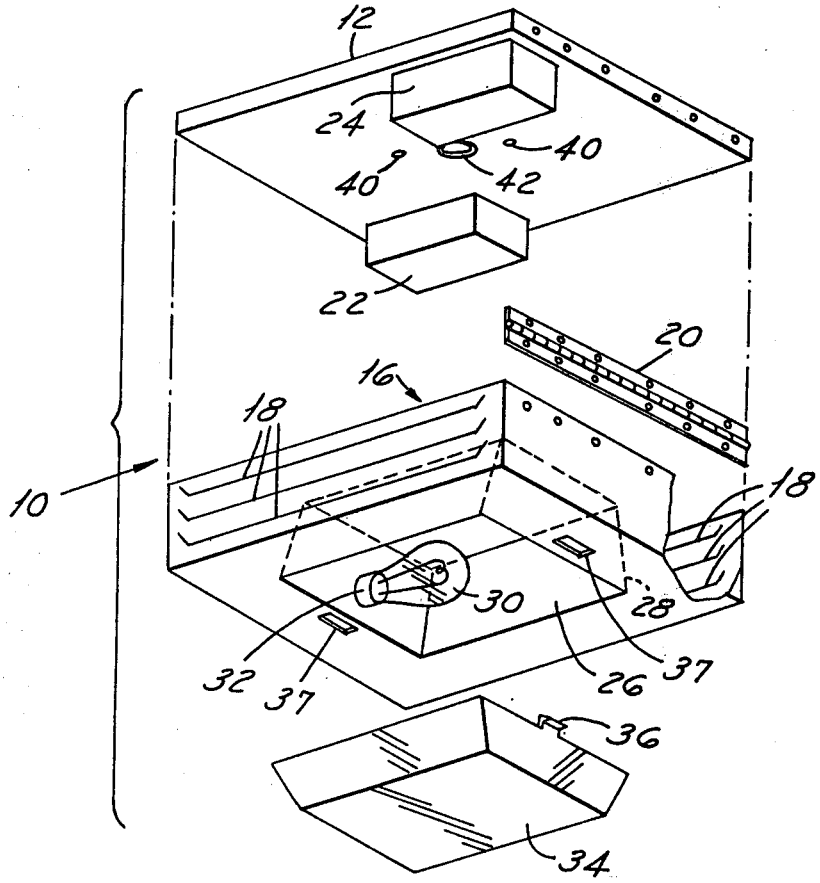
FIG. 2 is an exploded perspective view of the fixture shown in FIG. 1.

Referring to FIGS. 1 and 2, a composite fixture 10 in accordance with the present invention, specifically a combined smoke detector and lamp fixture in the embodiment depicted, is mounted at a room ceiling 11. Fixture 10 comprises a base plate 12 having a pair of centrally disposed holes 40 suitably spaced from each other for mounting base plate 12 to a conventional four-inch utility junction box (not shown), such that fixture 10 may be mounted in place of a previously-installed lamp fixture for example. A fixture control assembly 22, the details of which will be set forth hereinafter, and a conventional smoke detection element 24 are carried beneath and at opposite corners of plate 12. It is presently contemplated that smoke detection element 24 will be a typical ion- or particle-detecting unit of the type manufactured by BRK Electronics of Aurora, Illinois, for example, and may be purchased and installed onto base plate 12 without modification. The detector portion of a BRK Model SS769AC alarm has been found to yield satisfactory results. It is specifically contemplated and presently preferred that smoke detection element 24 be of the type adapted to be continuously powered by an a-c utility voltage.

A generally rectangular cover 16, having louvered air inlet openings 18 disposed along at least two opposed sides thereof, is mounted to base plate 12 by a hinge 20 such that cover 16 may be swung away from base plate 12 to expose smoke detection element 24 and control assembly 22 for maintenance and repair. A suitable latch arrangement (not shown) is provided at the opposed edges of plate 12 and cover 16 remote from hinge 20. A lamp 30 is received in a suitable socket 32 and is encompassed by a reflector 28 carried internally of cover 16 and communicating with an aperture 26 in the cover base. A translucent window 34 is received over aperture 26 and is removably mounted to cover 16 by means of a pair of axially extending window tabs 36 having tongues adapted to be received in a pair of corresponding notches 37 in the cover. Lamp 30 and smoke detection element 24 are connected to control assembly 22 by suitable conductors (not shown). As best seen in FIG. 1, fixture 10 is powered by means of a previously-installed two-conductor power cable 38 extending between the fixture and a typical wall switch enclosure 14, cable 38 being fed to control circuit 22 (FIG. 2) through a central hole 42 in base plate 12.

Figure 3:
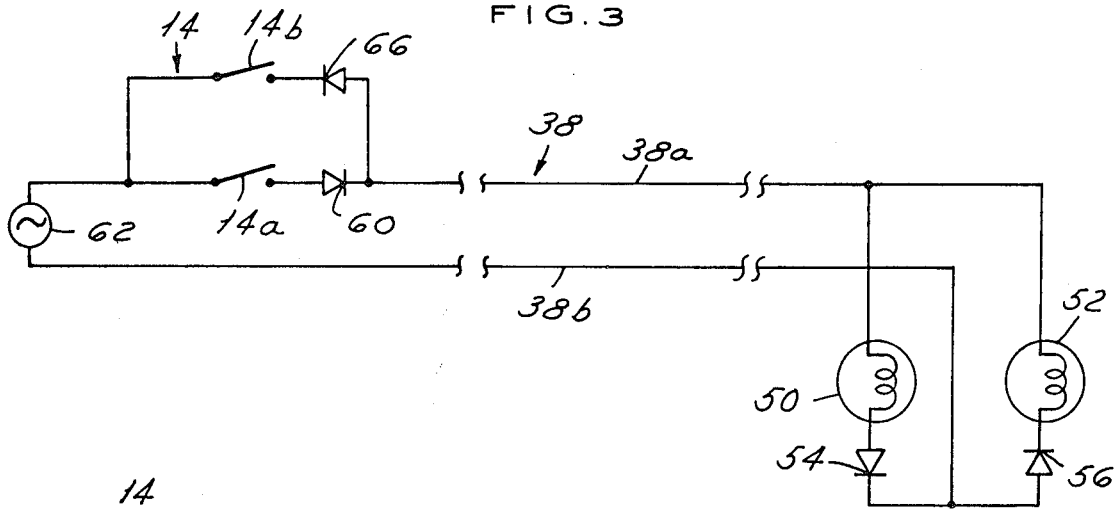
FIG. 3 is a schematic diagram of one embodiment of the control system provided by the invention.

In accordance with another important aspect of the present invention, a control circuit is provided for selectively applying a-c power to two apparatus from switch means located remotely of such apparatus. A first embodiment of the control circuit provided by the invention is illustrated in FIG. 3, wherein the first and second electrically-powered apparatus are represented by the lamps 50,52. Lamp 50 is connected across conductors 38*a*, 38*b* of cable 38 in series with a diode 54. Similarly, lamp 52 is connected across cable 38 in series with a second diode 56 poled oppositely of diode 54. A first switch 14*a* is connected in series with a diode 60 to apply a-c power to cable 38 from a utility power source 62 at a first state of rectification. A second switch 14*b* is connected in series with an oppositely poled diode 66 to apply power to cable 38 at a second state of rectification. Diodes 60,66 are preferably packaged with respective switches 14*a*,14*b* within an integral enclosure 14 (FIG. 1) with suitable terminals being provided on such enclosure for connection of conductor 38*a*, etc. When switch 14*a* is closed, half-wave rectified a-c power is applied to lamp 50 at a first state of rectification through diodes 60,54. Such power is blocked from lamp 52 by diode 56. Similarly, when switch 14*b* is closed, half-wave rectified a-c power of opposite rectification is applied by diodes 66,56 to lamp 52, but is blocked from lamp 50 by diode 54. Thus, lamps 50,52 may be selectively operated, either separately or together, in accordance with the condition of switches 14*a*,14*b*. Since the power applied to the respective lamps is half-wave rectified, the lamps only produce half of their rated illumination. Stated differently, if lamps 50,52 comprise respective one hundred watt bulbs, the illumination provided thereby would be equivalent to the normal of full-wave illumination of fifty watt bulbs.

The control circuit shown in FIG. 3 may be used for selectively powering any first and second electrical apparatus as long as each such apparatus may be powered by half-wave rectified a-c. Such apparatus may comprise separate lamps 50,52 in the form of a composite bathroom lamp and night-light fixture having a structure generally similar to that shown in FIG. 1 with both of the lamps 50,52 disposed beneath reflector 28. Diodes 54,56 would be mounted in such composite apparatus as control assembly 22 (FIG. 2). Alternatively, lamp 52 may be replaced by a smoke detector to comprise a composite smoke detection and lamp fixture wherein the smoke detector may be selectively powered by means of switch 14*b*. Fire alarm apparatus of the type which does not utilize a particle-detection theory, such as a heat-responsive switch, may also be used in combination with a lamp using the control circuit depicted in FIG. 3.

Figure 4:
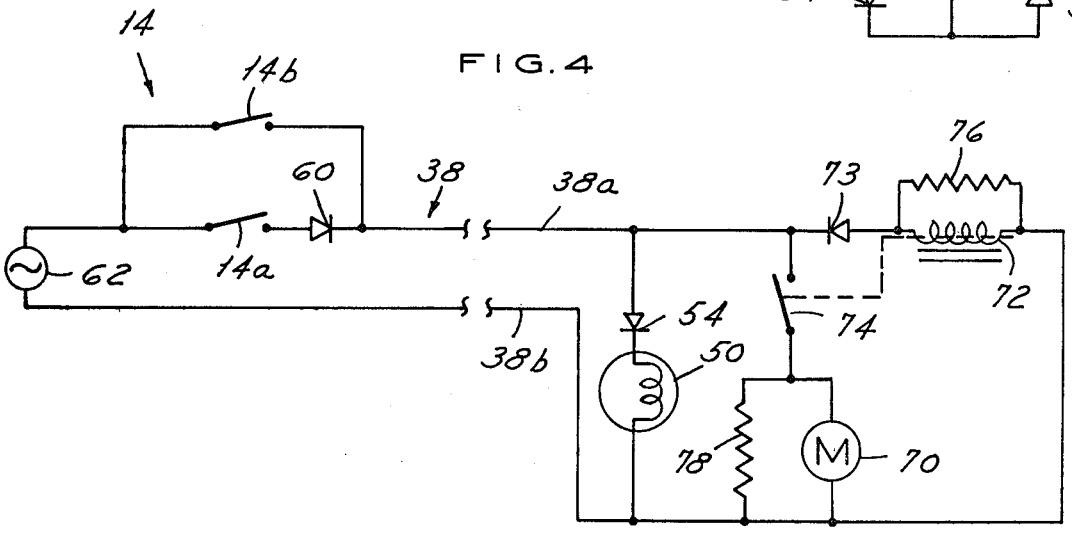
FIGS. 4 and 5 are schematic diagrams of respective alternative embodiments of the control system provided by the invention.

In an application wherein at least one apparatus must be powered by full wave a-c, the alternative control circuit configuration of FIG. 4 may be used wherein the first apparatus is depicted as a lamp 50 and the second apparatus is an a-c motor 70. Switch 14*b* is connected to apply full wave power to cable 38. A relay coil 72 is connected in series with a diode 73 across cable conductors 38*a*,38*b* such that half-wave rectified power at the second state of rectification is applied to coil 72 when switch 14*b* is closed. A relay switch 74 associated with relay coil 72 is connected in series with motor 70 across cable 38. Arc suppression resistors 76,78 are respectively connected across coil 72 and motor 70. When switch 14*b* is closed and relay coil 72 is energized, switch 74 closes to apply full-wave a-c power to motor 70. However, when switch 14*a* is closed to apply half-wave power to lamp 50, such power is blocked from coil 72 by diode 73. It will be appreciated, of course, that lamp 50 is powered when either switch 14*a* or switch 14*b* is closed. It is contemplated that the control circuit of FIG. 4 will be particularly useful in connection with a composite bathroom lamp and ventilation fixture, for example, wherein the smoke detection apparatus of FIGS. 1–2 is replaced by a motor-driven blower and vent, or the like. In such a configuration, diodes 54,73, relay 72,74 and resistors 76,78 would be packaged as control assembly 22 (FIG. 2). The embodiment of FIG. 4 may also be conveniently used in connection with a combined bathroom lamp and auxiliary heating fixture by using a suitable heater element as resistor 78 and disposing such element with respect to a blower fan driven by motor 70 to provide an intake of cool air and an exhaust of heated air through opposed fixture openings 18 (FIGS. 1 and 2).

Figure 5:
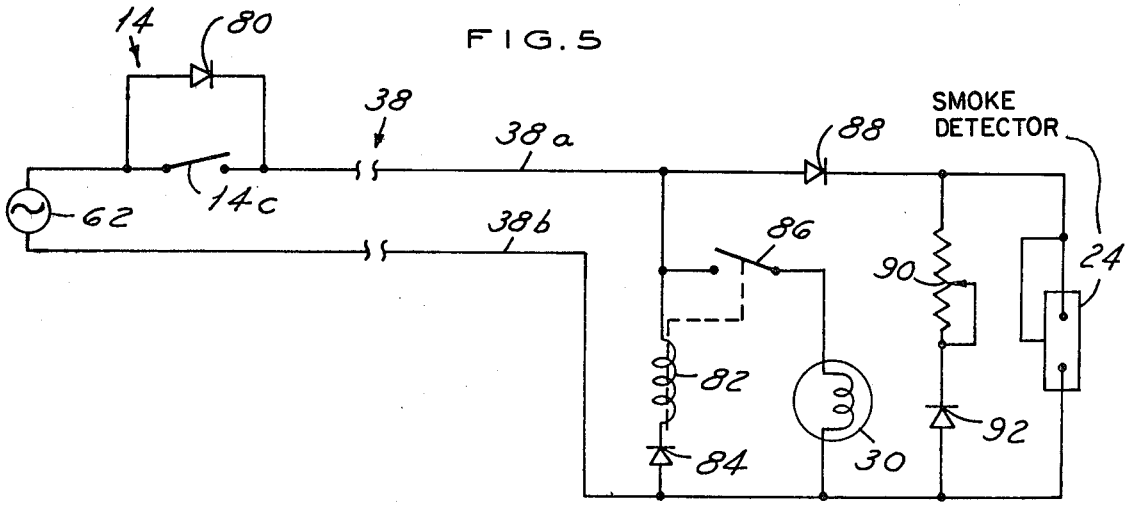

A third embodiment of the control circuit provided by the invention is shown in FIG. 5, and is particularly useful for applying continuous power to detection element 24 (FIG. 2) and selectable power to lamp 30 of a composite smoke detector and lamp fixture. Referring to FIG. 5, wherein reference numerals identical to those used in FIGS. 1 and 2 indicate identical components, a rectifying diode 80 is connected across the normally open contacts of wall switch 14*c* and is preferably packaged integrally therewith. Connected in parallel across conductors 38*a*,38*b* of cable 38 are the series combinations of a relay coil 82 and a second rectifying diode 84, lamp 30 and a relay switch 86 associated with coil 84, and a third rectifying diode 88 and detection element 24. Diodes 84,88 are poled in opposite directions, with diode 88 being poled in the same direction as diode 80. A variable resistor 90 and a rectifying diode 92 are connected across detection element 24 to suppress noise and ringing in the detector circuitry. Control assembly 22 (FIG. 2) for such embodiment would comprise diodes 84,88, 92 relay 82,86 and resistor 90.

With wall switch 14*c* in the open position, a-c utility power at a first state of rectification is gated through diodes 80 and 88 to apply continuous half-wave power to detection element 24. Power at the first state of rectification is blocked from relay coil 82 by diode 84. Thus, with switch 14*c* open, power is applied to smoke detection element 24 but is not applied to relay coil 82. Hence, relay switch 86 remains open and lamp 30 is de-energized. When switch 14*c* is closed, however, diode 80 is short circuited such that a-c power at a second state of rectification, i.e., full-wave power, is gated to and energizes relay coil 82. Switch 86 associated therewith is then closed, connecting both positive and negative half cycles of a-c power to the lamp 30. It will be recognized, of course, that the embodiment of FIG. 5 may be modified in accordance with FIGS. 3 and 4 to energize lamp 30 with half-wave rectified power. Similarly, either or both of the lamps 50,52 of FIGS. 3 and/or 4 may be energized by full-wave power by addition of suitable relays as shown in FIG. 5.

Figure 6:
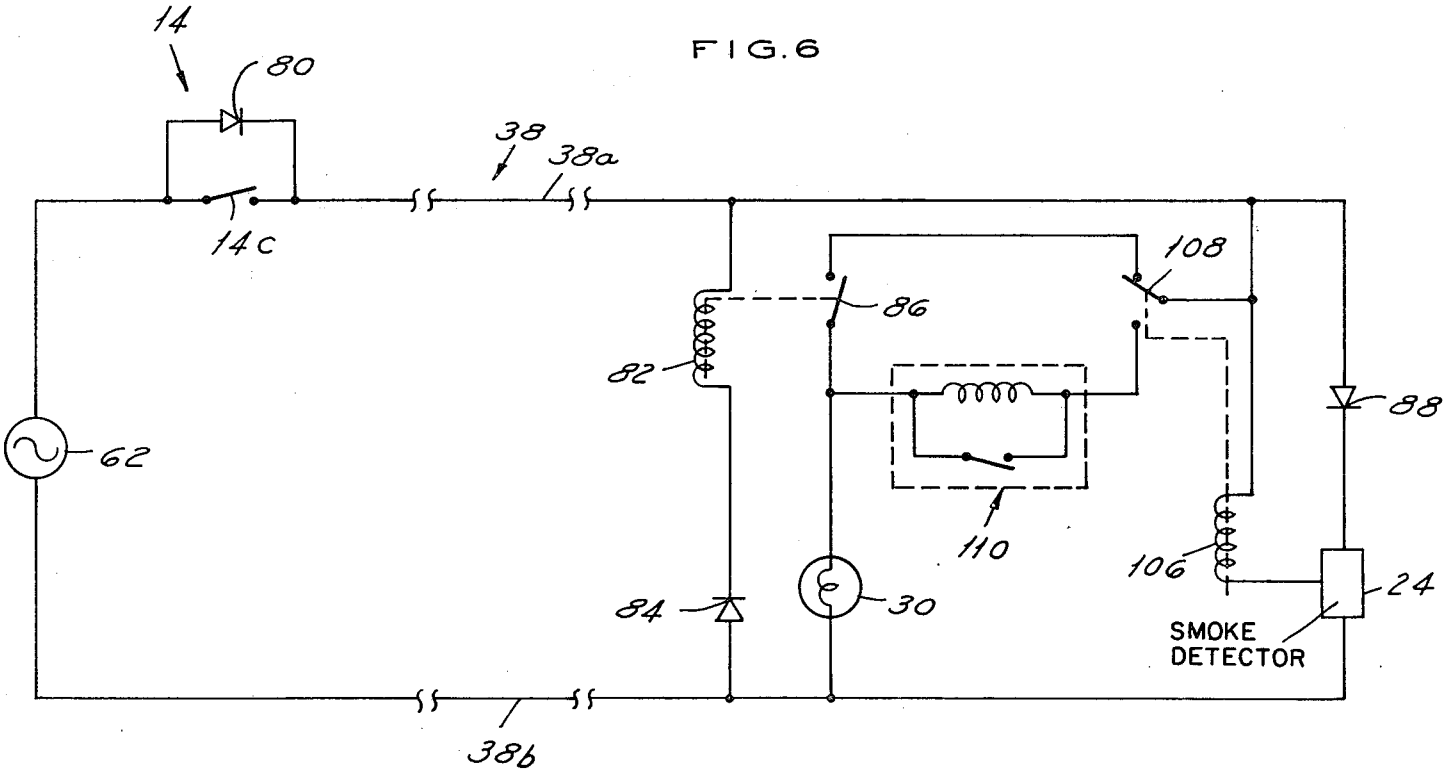
FIG. 6 is a schematic diagram of yet another alternative embodiment of the control system provided by the invention which is specifically adapted and presently preferred for use with a composite smoke detector and lamp fixture.

A modification of the control circuit illustrated in FIG. 5 and the presently preferred embodiment of the control circuit provided by the invention for use with a composite smoke detector and lamp fixture is shown in FIG. 6. Referring to FIG. 6, the parallel combination of normally open switch 14*c* and diode 80 is connected as described in connection with FIG. 5, and are preferably packaged within a single switch enclosure 14 (FIG. 1) which may be installed in place of the previously-existing switch at the time that fixture 10 is installed. Within fixture 10 (FIGS. 1 and 2), diode 84 and relay coil 82 are connected as described in connection with FIG. 5. Smoke detectors of the type contemplated herein usually have three power input terminals: a power terminal for the detector element, a power terminal for the internal alarm element and a neutral or ground terminal. Diode 88 is connected between conductor 38*a* and the detector power terminal in the embodiment of FIG. 6, and the neutral terminal is connected to conductor 38*b*. A relay coil 106 is connected between conductor 38*a* and the alarm power terminal. A relay switch 108 associated with coil 106 has a common contact connected to the junction of coil 106 and diode 88, a normally closed contact connected to the normally open contact of switch 86, and a normally open contact connected through a thermal flasher 110 directly to lamp 30. In the preferred control circuit embodiment of FIG. 6, control assembly 22 (FIG. 1) comprises diodes 84,88, relays 82,86 and 106,108, and thermal flasher 110. It will be recognized, of course, that diode 88 (FIGS. 5 and 6) could be conveniently included within detection circuitry 24.

In the operation of the embodiment of FIG. 6, closure of switch 14*c* energizes relay coil 82 and closes relay switch 86. With switch 108 in the normally closed position, full-wave power is applied to lamp 30. When an alarm condition is detected, current is drawn into the alarm terminal of detector 24, thereby energizing relay coil 106 and connecting conductor 38*a* to flasher 110 through switch 108. Lamp 30 is thereby flashed on and off independently of relay 82,86. If switch 14*c* is open when the alarm is detected, lamp 30 is flashed at half-wave intensity through diode 80. If switch 14*c* is closed, lamp 30 is flashed at full intensity.

From the foregoing description it will be appreciated that the composite fixture and the control circuit therefore provided by the invention and described in detail hereinabove fully satisfy all of the objects and aims previously set forth. The composite fixture has been described in detail in connection with a combined smoke detector and lamp fixture; however, several alternatives and modifications to this fixture have also been described: e.g., a combined bathroom lamp and ventilation fixture, a combined bathroom lamp and night-light fixture and a combined bathroom lamp and auxiliary heating unit. Other composite fixtures will also suggest themselves to the skilled artisan. Similarly, the control system provided by the invention has been described in connection with several alternative embodiments thereof. As with the composite fixture, additional modifications to the control system provided herein will suggest themselves to persons skilled in the art depending upon the fixture with which the control system is to be used. For example, it is possible in some applications that a battery-powered smoke detector may be desirable. In such applications, the second load to be selectively powered in the control circuit may comprise a battery-charger energized whenever the illumination lamp is turned off. Accordingly, the invention is intended to encompass the above-noted and all other alternatives, modifications and variations as fall within the spirit and broad scope of the appended claims.

The invention claimed is:

1. In an a-c utility power system, the combination comprising two electrically powered apparatus disposed at one location, at least one of said apparatus being adapted to be powered by full-wave a-c power, a two-conductor utility power cable, means operatively connecting the first and second power conductors of said cable to each said apparatus at said one location such that said first and second power conductors provide the only source of utility power to said apparatus, and switch means located remotely of said apparatus at a second location and connected to said conductors for applying a-c power to said conductors and said apparatus, said switch means comprising a switch having an open and a closed condition and means connected across said switch for applying continuous first a-c power to said conductors and said apparatus independently of said switch, said switch in said closed condition supplying second a-c power comprising full-wave a-c power to said conductors and said apparatus, said connecting means including first means at said one location responsive to said continuous first a-c power for applying said continuous power to a first of said apparatus and second means at said one location responsive only to said second a-c power for applying full-wave power to said at least one apparatus comprising said second apparatus.

2. The power system set for in claim 1 wherein said second means comprises relay means including normally open relay switch means and means operatively connected to said conductors and responsive to said second a-c power to for closing said relay switch means, said second apparatus being electrically connected in series with said relay switch means across said conductors to receive full-wave a-c power from said conductors only when said relay switch means is closed.

3. The power system set forth in claim 2 wherein said second apparatus adapted to be powered by said full-wave a-c power comprises a lamp.

4. The power system set forth in claim 2 or 3 wherein said first apparatus comprises a smoke detector.

5. In an a-c utility power system, the combination comprising two electrically powered apparatus disposed at one location, at least one of said apparatus being adapted to be powered by full-wave a-c power, a two-conductor utility power cable, means operatively connecting the first and second power conductors of said cable to each said apparatus at said one location such that said first and second power conductor provide the only source of utility power to said apparatus, and switch means located remotely of said apparatus at a second location and connected to said conductors for selectively applying a-c power to said conductors at first and second states of rectification, said switch means including a first switch having an open and a closed condition and rectifier means including a first rectifier operatively connected across said switch such that said first state of rectification comprises half-wave rectification through said first rectifier and said second state of rectification comprises full-wave power through said switch, said connecting means including first means at said one location responsive only to a-c power at said first state of rectification for applying a-c power to a first said apparatus and second means at said one location responsive to a-c power at said second state of rectification for applying full-wave power to said at least one apparatus comprising a second of said apparatus.

6. In an a-c utility power system, the combination comprising two electrically powered apparatus disposed at one location, first and second electrical conductors, means operatively connecting said first and second conductors to each said apparatus at said one location, and switch means located remotely of said apparatus at a second location and connected to said conductors for selectively applying a-c power to said conductors at first and second states of rectification, said connecting means including first means comprising a rectifier responsive only to a-c power at said first state of rectification for applying a-c power to a first said apparatus and second means responsive only to a-c power at said second state of rectification for applying a-c power to a second said apparatus, said first apparatus comprising a relay having a normally open relay switch and a relay coil operatively connected in series with said rectifier across said first and second conductors and means including an a-c motor adapted to be powered by full-wave a-c operatively connected in series with said relay switch to receive full-wave utility power from said first and second conductors.

7. In an a-c utility power system, the combination comprising two electrically powered apparatus disposed at one location, at least one of said apparatus being adapted to be powered by full-wave a-c power, a two-conductor utility power cable, means operatively connecting the first and second power conductors of said cable to each said apparatus at said one location such that said first and second power conductor provide the only source of utility power to said apparatus, and switch means located remotely of said apparatus at a second location and connected to said conductors for selectively applying a-c power to said conductors at first and second states of rectification, said switch means including a first switch having an open and a closed condition and rectifier means including a first rectifier operatively connected across said switch such that said first state of rectification comprises half-wave rectification through said first rectifier and said second state of rectification comprises full-wave power, said connecting means including first means at said one location responsive only to a-c power at said first state of rectification for applying a-c power to a first said apparatus and second means at said one location responsive only to a-c power at said second state of rectification for applying full-wave power to said at least one apparatus comprising a second said apparatus.

8. The power system set forth in claim 7 wherein said first and second means respectively comprise oppositely poled second and third rectifiers, said third rectifier being poled in opposition to said first rectifier, and wherein said second means additionally comprises relay means having a normally open relay switch and means operatively connected in series with said third rectifier across said first and second conductors for closing said relay switch when power is applied to said conductors at said second state of rectification, said second apparatus adapted to be powered by full-wave a-c being electrically connected in series with said relay switch to receive utility power from said first and second conductors when said relay switch is closed.

9. The power system set forth in claim 7 wherein said switch means comprises first and second parallel switches, said second switch being operatively connected in series wtih said first rectifier such that power at said first state of rectification is selectively applied to said first apparatus in accordance with the conductive condition of said second switch.

10. The power system set forth in claim 7 wherein said first apparatus is adapted to be powered by half-wave rectified utility power, and wherein said first means comprises a rectifier poled to conduct half-wave rectified a-c power at said first state of rectification to said first apparatus.

11. The power system set forth in claim 10 wherein said first apparatus comprises a lamp.

12. The power system set forth in claim 9 wherein said second means comprises a lamp.

13. The power system set forth in claim 9 wherein said second means comprises an a-c motor.

14. The power system set forth in claim 6 wherein said last-named means further comprises a resistive heater element.

15. The power system set forth in claim 9 wherein said second means comprises a smoke detector.

* * * * *

UNITED STATES PATENT AND TRADEMARK OFFICE

CERTIFICATE OF CORRECTION

PATENT NO. : 4,167,688

DATED : September 11, 1979

INVENTOR(S) : Michael J. Burek and Robert S. White

It is certified that error appears in the above-identified patent and that said Letters Patent are hereby corrected as shown below:

Claim 15:

Column 8, Line 47, "second" should read

-- first --.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*